United States Patent [19]

Chwyla

[11] 4,307,777

[45] Dec. 29, 1981

[54] HEAT EXCHANGER TUBE SUPPORT

[75] Inventor: Wasyl Chwyla, Ottawa, Canada

[73] Assignee: Combustion Engineering, Inc., Windsor, Conn.

[21] Appl. No.: 99,108

[22] Filed: Nov. 30, 1979

[51] Int. Cl.[3] ..... F22B 37/24; F28F 9/00

[52] U.S. Cl. ..... 165/76; 122/510; 165/82; 165/162

[58] Field of Search ..... 122/510; 165/162, 172, 165/82, 76

[56] References Cited

U.S. PATENT DOCUMENTS

| | | | |
|---|---|---|---|
| 2,923,279 | 2/1960 | Schmidli | 165/162 |
| 3,265,044 | 8/1966 | Juchtern | 122/510 |
| 3,267,913 | 8/1966 | Brühl | 122/510 |
| 4,100,889 | 7/1978 | Chayes | 122/510 |

FOREIGN PATENT DOCUMENTS

| | | | |
|---|---|---|---|
| 20055 | 6/1929 | Netherlands | 122/510 |

*Primary Examiner*—Sheldon J. Richter
*Attorney, Agent, or Firm*—Edward L. Kochey, Jr.

[57] ABSTRACT

A support arrangement for horizontal tubes (14) located in a gas pass. Vertical hanger tubes (20) have longitudinal fins (30) on opposite sides thereof, and a U strap (32) is arranged to surround the horizontal tube to be supported with the U strap welded only to the longitudinal fin.

4 Claims, 5 Drawing Figures

HEAT EXCHANGER TUBE SUPPORT

BACKGROUND OF THE INVENTION

This invention relates to heat exchangers and in particular to an apparatus for supporting horizontal tubes in a flow of hot gas.

Steam generators frequently include horizontal heating surface forming an economizer, a superheater or a reheater. This surface is normally located in the rear gas pass with hot gas flowing downwardly over the heating surface. Each section normally consists of a plurality of sinuous tubes in parallel flow relationship with one another so that the flow passing through the section is heated to a desired temperature level.

One known method to support these tubes involves the use of vertical hanger tubes passing through the gas pass with the horizontal tubes being attached to some manner to the vertical tubes.

These vertical tubes are normally fluid cooled and must be strong enough to support the accumulated load of all the tubes. Stress concentrations should be avoided on these heavily loaded tubes. The attachment to these tubes is also a source of potential stress concentration due not only to the loading of the tubes but to expansion forces and possible vibration of the supported tube.

Differential expansion of the supported tubes can often be taken by permitting flexing of the support tube where the differential expansion between adjacent supports is small and predictable. The expansion becomes large at certain locations such as between tube banks operating at different temperatures. Also a change from ferritic to austenitic material will create a local sizable expansion difference. Furthermore, two parallel circuits attached between the same pair of hanger tubes may operate at different temperatures and, accordingly, create high stresses in the tubes and in the supports.

It has been known to support these horizontal tubes by welding the tube directly to either the vertical hanger tube itself or a fin on the hanger tube. This requires welding directly on the pressure part which frequently requires a post weld heat treatment. Furthermore, since the beginning and end of a weld tends to be a point of stress concentration, it provides a potential failure area on a pressure part itself.

Alternately, the horizontal tubes have been supported on lugs cantilevered out from the vertical tube without any direct welding between the horizontal and vertical tubes. On occasions, straps have been placed around the tubes to preclude their falling from the support lug. This provides for longitudinal differential expansion of the horizontal tubes. This has produced complex fabrication arrangements and also tends to provide an unfavorable stress concentration on the support lug. The downward loading on the lug leads to a high stress at the upper edge of the lug where it is welded to the support tube. This stress is combined with a weld start or stop point and, therefore, tends to produce a stress concentration at an unfavorable point.

SUMMARY OF THE INVENTION

A heat exchanger has walls confining a flow of hot gases and at least one tube bank which includes a plurality of horizontal tubes such as an economizer or superheater. These tubes are located in the gas pass with the horizontal tubes being parallel to one another and groups of the tubes sinuously connected in series flow relationship.

Vertical fluid cooled hanger tubes have longitudinal fins extending throughout a substantial portion of their length on opposite sides of the hanger tube. A U strap surrounds and supports the horizontal tube at the support locations with the two legs of the strap being welded on to the longitudinal fin.

Accordingly, the only weld to a pressure part is the longitudinal fin which is shop welded and may be conveniently heat treated. Furthermore, it is a single fin throughout the entire length without repeated stress concentrations where each fin stops and starts and without a welding stop and start location in the high stress area. The supported tubes are free to expand since they can readily slide through the U strap. Various spacings can be accommodated with a single hanger tube size, as may occur with an economizer and reheater tube bank supported above one another, by locating scallops as required in the longitudinal fin.

DESCRIPTION OF THE PREFERRED EMBODIMENT

Figure 1:
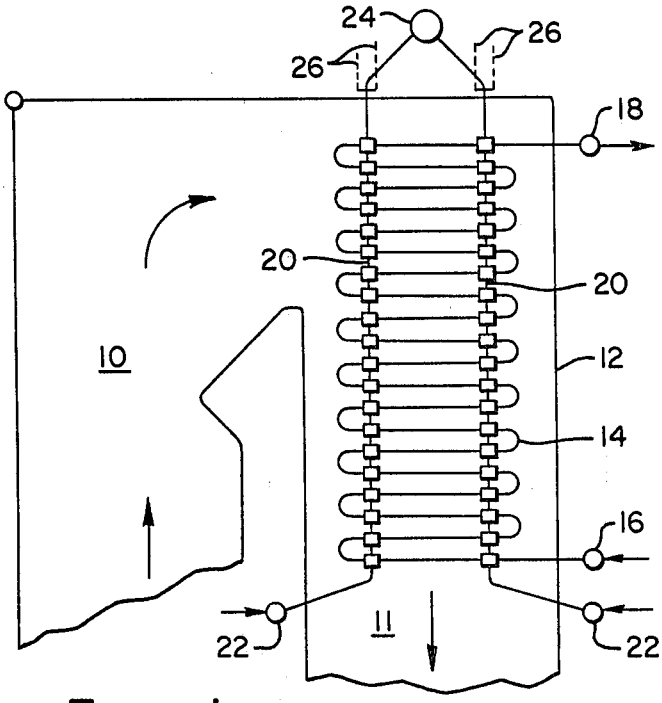
FIG. 1 is a schematic side elevation of a steam generator showing a general arrangement of the horizontal surface support.

Steam generator 10 includes a furnace producing hot gases which flow downwardly through the rear gas pass 11 which is formed of a plurality of walls 12. The horizontal heating surface 14 to be supported may be economizer, superheater or reheater surface, or a series of banks of tubes containing different fluids. The fluid to be heated will normally enter the inlet header 16 flowing upwardly through a sinuous flowpath in a plurality of parallel circuits to outlet header 18.

Fluid cooled hanger tubes 20 are supplied with a coolant such as saturated steam through inlet header 22 with the steam flowing upwardly through the hanger tubes to outlet header 24. These hanger tubes are supported at an upper elevation by supports 26'.

Figure 2:
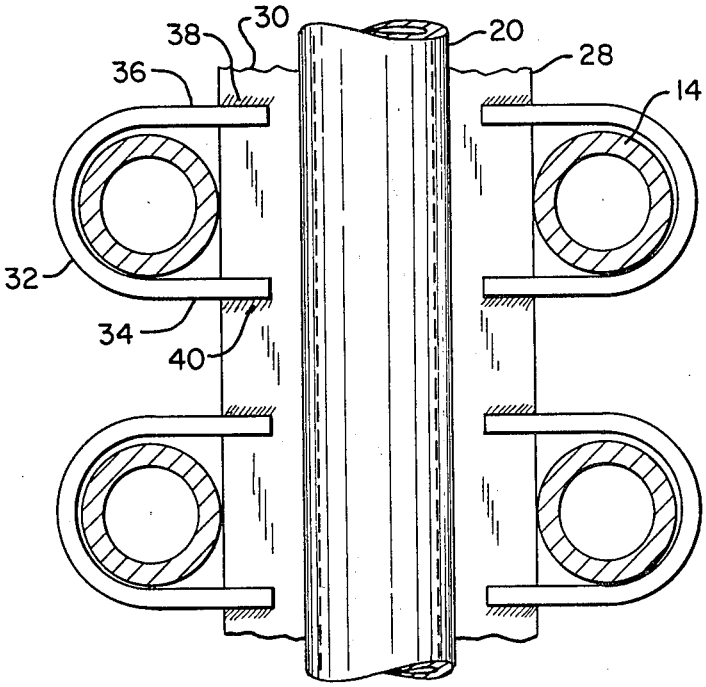
FIG. 2 is a side elevation illustrating the support of several horizontal tubes.

Referring to FIG. 2, the vertical hanger tube 20 includes two longitudinally-extending fins 28 and 30 located on opposite sides of the hanger tube. This fin is continuous throughout a substantial length of the tubing, for instance the length of the tube bank to be supported or where a plurality of banks are to be supported it may extend continuously throughout the series of tube banks.

A U strap 32 is arranged to surround and support each of the horizontal tubes 14 with both the lower leg 34 and the upper 36 of each U strap being welded to the longitudinally-extending fin 30. This is the only weld made on the U strap, and it can be seen that there is no welding to a pressure part. The vertical load is taken by both welds with bending due to eccentric loading being spread between the upper weld 38 and the lower weld 40.

Figure 3:
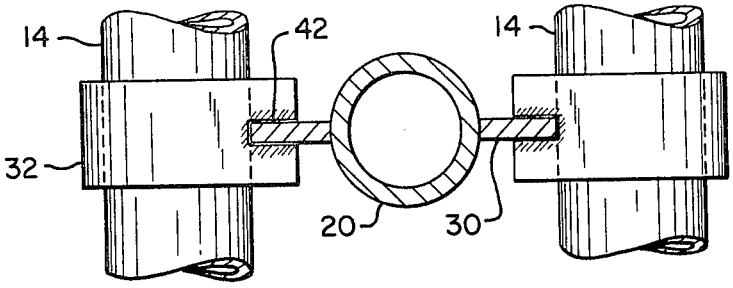
FIG. 3 is a plan section through FIG. 2.

As best illustrated in FIG. 3, each leg of the fin may include a slot 42 adapted to engage the longitudinal fin and permit welding on both sides thereof.

Figure 4:
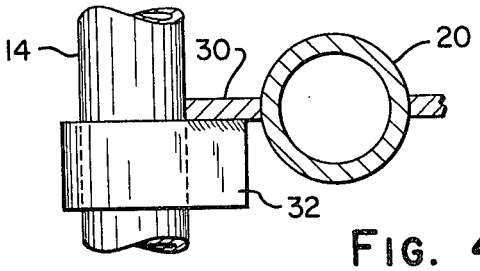
FIG. 4 is a plan section of an alternate construction of FIG. 2.

An alternate embodiment in FIG. 4 illustrates a construction without the slot using only one U lug. Two side-by-side U straps could be used to permit welding on both sides of the longitudinally-extending fin where additional strength is required.

Figure 5:
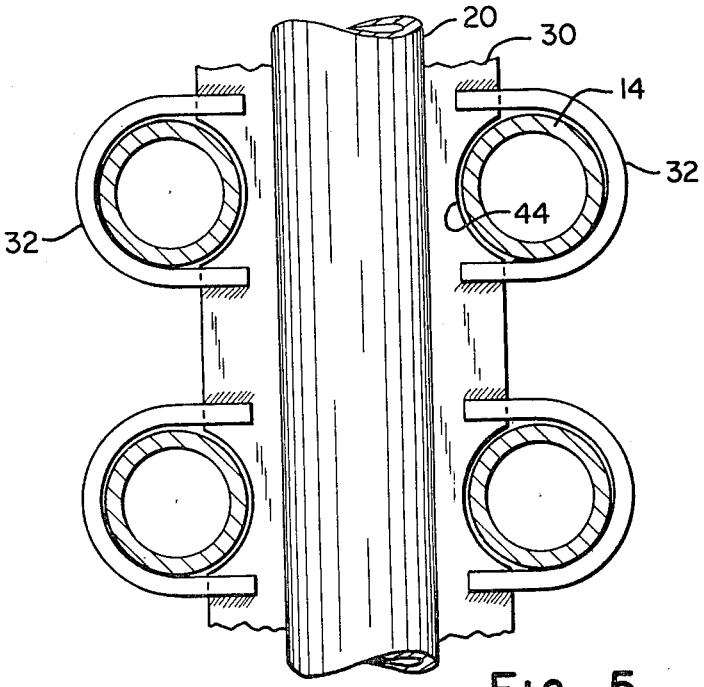
FIG. 5 illustrates an alternate embodiment using scalloped fins.

There may be occasions where one bank of tubes to be supported results in less clearance between the adjacent tubes than another bank. Hanger tubes running throughout the entire length of the rear gas pass cannot conveniently change spacing where they are being used as support tubes. Accordingly, the embodiment of FIG. 5 includes scallops 44 in the fins. It can be seen that the U straps 32 are welded to the longitudinal fin where it has its full width. This provides ample welding space to avoid high stresses and still avoids any need to weld on the pressure parts.

I claim:

1. In a heat exchanger having walls confining a flow of hot gases, at least one tube bank including a plurality of horizontal tubes located in the gas pass and conveying a fluid therethrough, said horizontal tubes being parallel to one another, and groups of said tubes sinuously connected in series flow relationship; an apparatus for supporting said horizontal tubes comprising: vertical hanger tubes supported at an upper elevation; means for passing fluid through said hanger tubes; continuous longitudinal fins on said hanger tubes extending beyond said plurality of horizontal tubes and located on opposed sides of hanger tubes; U straps, located at a lower elevation surrounding and supporting said horizontal tube, the two legs of each of said straps welded only to said longitudinal fins.

2. An apparatus as in claim 1 having at least two of said vertical hanger tubes supporting each of said horizontal tubes.

3. An apparatus as in claim 1 or 2 wherein said U strap has a slot in each of its two legs such that the longitudinal fin fits within said slot, thereby permitting welding to both sides of said longitudinal fin.

4. An apparatus as in claim 1 or 2 wherein said longitudinal fin is scalloped at the tube locations, and said horizontal tubes are arranged to fit within said scallops.

* * * * *